US009212449B2

(12) United States Patent
Fang et al.

(10) Patent No.: US 9,212,449 B2
(45) Date of Patent: Dec. 15, 2015

(54) STRUCTURAL DOOR BOWL FOR A HOUSEHOLD APPLIANCE DOOR

(75) Inventors: Huiyu Fang, New Bern, NC (US); Oliver Schöne, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 1098 days.

(21) Appl. No.: 12/872,025

(22) Filed: Aug. 31, 2010

(65) Prior Publication Data

US 2012/0049703 A1 Mar. 1, 2012

(51) Int. Cl.
*D06F 39/14* (2006.01)

(52) U.S. Cl.
CPC ..... *D06F 39/14* (2013.01)

(58) Field of Classification Search
USPC ..... 68/13 R, 196; 312/228, 228.1
See application file for complete search history.

(56) References Cited

U.S. PATENT DOCUMENTS

| | | | | |
|---|---|---|---|---|
| 6,748,771 | B2 | 6/2004 | Nitschmann et al. | |
| 7,269,981 | B2 | 9/2007 | Kwon | |
| 7,320,186 | B2 | 1/2008 | Schone | |
| 7,478,502 | B2 | 1/2009 | Bienick et al. | |
| 7,698,910 | B2 | 4/2010 | Kim et al. | |
| 7,735,346 | B2 | 6/2010 | Ha et al. | |
| 2004/0089031 | A1 | 5/2004 | Kim et al. | |
| 2004/0107741 | A1 | 6/2004 | Kim et al. | |
| 2006/0156767 | A1 | 7/2006 | Kim et al. | |
| 2007/0075614 | A1 | 4/2007 | Calmeise | |
| 2007/0125132 | A1 | 6/2007 | Hwang | |
| 2008/0028804 | A1 | 2/2008 | Hoppe et al. | |
| 2008/0302141 | A1 * | 12/2008 | Chung | 68/196 |
| 2009/0064593 | A1 | 3/2009 | Ha | |
| 2010/0031581 | A1 * | 2/2010 | Kang et al. | 49/507 |
| 2010/0088917 | A1 | 4/2010 | Lim | |
| 2011/0023561 | A1 | 2/2011 | Murrell et al. | |

FOREIGN PATENT DOCUMENTS

| | | | |
|---|---|---|---|
| CN | 1888274 | A | 1/2007 |
| EP | 0870861 | A1 | 10/1998 |
| WO | WO 03004754 | A1 * | 1/2003 |

OTHER PUBLICATIONS

International Search Report PCT/EP2011/064057.

* cited by examiner

*Primary Examiner* — David Cormier
(74) *Attorney, Agent, or Firm* — James E. Howard; Andre Pallapies

(57) ABSTRACT

A glass bowl for a door assembly of a washer, in which the glass bowl includes a bowl portion having an open end and a closed end; and a flange extending radially from a perimeter of the open end of the bowl portion and in a plane that corresponds to a plane of the door assembly for securing the glass bowl to the door assembly. The flange includes a plurality of stiffening features for fixedly engaging a portion of a door frame or an inner ring of the door assembly for increasing a stiffness of the door assembly. The door fame or the inner ring include a plurality of corresponding stiffening features for engaging the stiffening feature of the glass bowl.

36 Claims, 10 Drawing Sheets

STRUCTURAL DOOR BOWL FOR A HOUSEHOLD APPLIANCE DOOR

FIELD OF THE INVENTION

The present invention is directed toward a household appliance, and more particularly, to a door assembly of a household appliance, such as a washer, having a see-through portion, and more particularly, to a structural door bowl and door frame of a household appliance that reduces or minimizes deformation of the door assembly of the household appliance.

BACKGROUND OF THE INVENTION

A household appliance, such as a clothes washer, generally includes a door that covers an opening for accessing the interior of the appliance. Such clothes washers commonly include a housing, a rotating drum disposed within the housing, and a driver device for driving the rotating drum. In operation, the door of the appliance is opened and clothes or laundry are inserted into the washer through the opening and placed in the rotating drum and the door is then closed.

Front-load clothes washers, which have a door positioned on the front of the appliance, have become increasingly popular in recent years for household use. The door commonly includes a glass bowl that permits the user to view or inspect inside the washing machine while the door is closed. The conventional glass bowl commonly includes a base portion for securing the glass bowl to the door and a bowl portion extending into the interior of the drum of the washer when the door is in the closed position.

An example of a conventional door assembly for a washer is described in U.S. patent application Ser. No. 12/533,038, the entire contents of which are incorporated herein. One of ordinary skill in the art will recognize that the illustrated door assembly is shown for exemplary purposes only and other arrangements of the door assembly are possible.

For example, with reference to FIGS. 11A and 11B, a conventional door assembly for a household appliance, such as a washer, may include, for example, an inner (first) door frame 60, a glass bowl 70, and an inner ring (or second door frame) (not shown in FIGS. 11A and 11B) that is covered by, or integrally formed with, a front cover 80.

As shown in FIG. 12, the door frame 60 can have a substantially circular shape when viewed from the front. However, other shapes are possible. The door frame 60 commonly includes an opening 62 that corresponds to a see-through portion 14 of the washer door 100, as exemplarily illustrated in FIG. 1. The opening 62 can have, for example, a circular or oval shape, as illustrated, as well as other shapes. The opening 62 can be centered (e.g., concentric) within the door frame 60, or off-center. For example, FIG. 12 illustrates a center of the opening 62 that is offset from, or above, a center of the door frame 60 such that a distance from the opening 62 to the outside edge of the door frame 60 is greater at the bottom portion of the washer door 100 than at the top portion of the washer door 100. The door frame 60 may include a rib pattern to stabilize and strengthen the door frame 60. The features of the door frame 60, such as fastener or screw points, can be configured to correspond to the features of the other components of the washer door, such as an inner ring (not shown) or an outer cover (not shown). The door frame 60 can include hinge pockets 66 for receiving a hinge (not shown) and a portion 68 for engaging a door hook or latch (as shown in FIGS. 11A and 11B). The door assembly also includes a door hook or latch 90 for engaging a latch receptacle (not shown) on the housing 12 of the washer 10 and securing the door in a closed position.

As shown in FIG. 13, a conventional glass bowl 70 can include a base portion and a bowl portion. The base portion can include a flange 76 that extends radially from the bowl portion in a plane that corresponds to a plane of the door when in an assembled position. The bowl portion commonly includes a sidewall 72 extending from the base portion toward the interior of the washing compartment of the washer 10. The bowl portion commonly includes a face 74 that faces toward the interior of the washing compartment of the washer 10 in the assembled position.

The glass bowl 70 commonly is assembled with the door frame 60 by inserting the bowl portion into the opening 62 of the door frame 60. In the assembled position, the flange 76 of the glass bowl 70 engages a ring portion of the door frame 60, while the face 74 and sidewall 72 of the bowl portion extend into the interior of the washing compartment of the washer 10. In this manner, the glass bowl 70 provides means for viewing or inspecting the interior of the washer 10.

In the conventional door assembly shown in FIGS. 11A-13, the flange 76 of the glass bowl 70 is press-fit between the door frame 60 and an inner ring (not shown). In this manner, the glass bowl 70 simply is held in place by the door frame and inner ring, and the forces acting on the door frame or inner ring are not transferred to the glass bowl. This is similar to other conventional door assembly designs in which the flange of the glass bowl rests or is press-fit into a groove or seating rib formed on the door frame to hold the glass bowl in place. In these cases, the forces acting on the door frame or inner ring are not transferred to the glass bowl.

In operation, the appliance door, such as the washer door, can be pivoted about a hinge from an open position to a closed position covering the opening of the appliance housing and latched in the closed position for operation of the washer.

Over time, a conventional appliance door commonly may change position from an original position of the door with respect to the washer housing. This change in position can affect the operation of the door, and more particularly, the closing action of the door and the alignment of a door latch with a latch receptacle on the housing. For example, the appliance door may begin to sag (i.e., move or sink to a lower position or angle from the original position) as a result of forces being applied to the door, such as the weight of the door itself, the weight of individual components of the door assembly, and/or as a result of other forces, such as a user leaning on the door, laundry being hung over the door, etc., among other things.

SUMMARY OF THE INVENTION

The present invention addresses these problems and others by providing a plurality of stiffening features on the glass bowl and corresponding locking features on the door frame or door ring to lock or fix the door frame or door ring with respect to the glass bowl, thereby taking advantage of the greater stiffness of the glass bowl, as compared to the plastic door frame or inner ring, to increase the stiffness of door assembly while also assisting with locating and positioning of these components during assembly. In this manner, the present invention can reduce door sagging over time.

The present invention recognizes that door sagging can be induced by several factors, including for example, hinge fatigue deformation and door frame creep deformation.

In the first case, hinge fatigue deformation can result over time, for example, from forces being applied to the door that act on the connection between the door and the hinge, the door hinge itself, and/or the connection between the door hinge and the housing, thereby causing the door to sag from its original position. These forces can include the weight of the door itself, and/or other forces, such as a user leaning on the door, laundry being hung over the door, etc., among other things.

In the second case, door frame creep deformation can result over time, for example, from forces being applied to the door that act on the components of the door itself. These forces similarly can include the weight of the door itself, the weight of individual components of the door assembly, and/or other forces, such as a user leaning on the door, laundry being hung over the door, etc., among other things.

For example, with reference to FIGS. 11A-13, over time, one or more of the inner door frame 60 and the inner ring (not shown), or another part of the door assembly may undergo creep deformation, thereby changing shape, e.g., from a circular-shape to an oval-shape. Such creep deformation of one or more of the parts of the door assembly may affect the operation of the door, and more particularly, the closing action of the door and the alignment of the door latch 90 with the latch receptacle (not shown) on the housing 12, or the fit between parts of the door.

The present invention recognizes that each part of the door assembly can contribute to the door frame creep deformation. Also, the door frame creep properties can change (e.g., increase or intensify) over time, thereby resulting in a substantial amount of door sagging. The present invention recognizes that increasing the stiffness of the door frame assembly can reduce door frame creep deformation, particularly over time, thereby substantially reduce door sagging.

These problems and others are addressed by the present invention, a first exemplary embodiment of which comprises a glass bowl for a door assembly of a washer, the glass bowl comprising a bowl portion having an open end and a closed end; and a flange extending radially from a perimeter of the open end of the bowl portion and in a plane that corresponds to a plane of the door assembly for securing the glass bowl to the door assembly, wherein the flange includes a plurality of stiffening features for fixedly engaging a plurality of portions of one of a door frame and an inner ring of the door assembly for increasing a stiffness of the door assembly.

Another exemplary embodiment of the invention comprises a door frame for a door assembly of a washer, the door frame comprising a first face having an outside edge and an inside edge, wherein the inside edge defines an opening in the first face that substantially corresponds to a shape of a glass bowl of the door assembly, and wherein the first face includes a surface surrounding a perimeter of the inside edge that abuts a flange of the glass bowl of the door assembly in an assembled state; and a second face on an opposite side of the door frame from the first face; wherein the first face includes a plurality of stiffening features for fixedly engaging a plurality of portions of the flange of the glass bowl of the door assembly for increasing a stiffness of the door assembly.

Another exemplary embodiment of the invention comprises a washer comprising a housing having an opening for accessing an interior of the housing; a tub disposed inside the housing, the tub having a rotating drum therein for receiving laundry through the opening; and a door assembly having a see-through portion for viewing into the tub, the door assembly being pivotably coupled to the housing and movable between an open position for accessing the opening of the housing and a closed position for closing the opening of the housing, wherein the door assembly includes a glass bowl including a bowl portion having an open end and a closed end and a flange extending radially from a perimeter of the open end of the bowl portion and in a plane that corresponds to a plane of the door assembly for securing the glass bowl to the door assembly; a door frame having a first opening that receives the bowl portion of the glass bowl, and a first surface that surrounds the first opening and that is adjacent to a first side of the flange of the glass bowl; and an inner ring having a second opening that corresponds to a shape of the bowl portion of the glass bowl, and a second surface that surrounds the second opening and that is adjacent to a second, opposite side of the flange of the glass bowl, wherein the door frame and the inner ring cooperate to support the glass bowl, and wherein the flange includes a plurality of first stiffening features fixedly engaging a plurality of second stiffening features of one of the door frame and the inner ring of the door assembly for increasing a stiffness of the door assembly.

For purposes of this disclosure, a stiffening feature is defined as a feature formed on one of a glass bowl, a door frame, or an inner ring of the door assembly that engages or mates with a corresponding feature of another of the glass bowl, the door frame, or the inner ring to rigidly fix the door frame and/or the inner ring with respect to the glass bowl. The glass bowl, door frame, and/or inner ring each can include one or more corresponding stiffening features (e.g., a pair of first, second, and/or third stiffening features) formed thereon that engage or lock with each other to rigidly fix the door frame and/or the inner ring with respect to the glass bowl. For example, the stiffening feature can include one or more of a male engaging part, such as a projection, a lobe, a plurality of lobes, or similar part, and/or a female engaging part, such as a socket, receptacle, or similar part.

In this manner, the exemplary embodiments of the present invention can increase a stiffness of the door assembly by providing a locking feature on the glass door bowl as a rigid fixation to the frame member, thereby reducing or minimizing door frame creep deformation, and hence, reducing or minimizing sagging of the washer door.

The present invention recognizes that the stiffness of the glass bowl commonly is greater than the stiffness of the door frame or inner ring (e.g., plastic inner door frame and plastic inner ring). The present invention takes advantage of the greater stiffness of the glass bowl, as compared to the plastic frame or inner ring, to increase the stiffness of the overall door assembly, thereby improving a resistance of the door assembly to creep deformation and maintaining the original shape, or minimizing the changes to the original shape, of the door assembly.

By providing the locking portions on the door frame and/or on the inner ring that correspond to and engage the projections of the glass bowl, the exemplary embodiments can increase the stiffness of the door assembly. The locking portions also can assure the positioning and orientation of the glass bowl with respect to the door frame and/or the inner ring.

The stiffening features also can increase the contact surface between the glass bowl and the door frame or inner ring. In this manner, the present invention can distribute the forces exerted on the door assembly over a larger area between the glass bowl and the door frame or inner ring, thereby increasing the amount of force that can be applied to the door assembly without sagging.

The present invention can take advantage of existing design features to further strengthen the fixation between the glass bowl and the door frame or inner ring. For example, the locking portions on the door frame or the inner ring can be positioned adjacent to strengthening ribs that are already present in the design of the door frame or inner ring. In this manner, by joining or abutting one or more of the locking features to a strengthening rib, the present invention can reinforce the locking portions of the door frame or inner ring without adding additional parts, materials, and/or complexity to the design.

Other features and advantages of the present invention will become apparent to those skilled in the art upon review of the following detailed description and drawings.

BRIEF DESCRIPTION OF THE DRAWINGS

These and other exemplary aspects and features of embodiments of the present invention will be better understood after a reading of the following detailed description, together with the attached drawings, wherein.

DETAILED DESCRIPTION OF THE EXEMPLARY EMBODIMENTS OF THE PRESENT INVENTION

Figure 1:
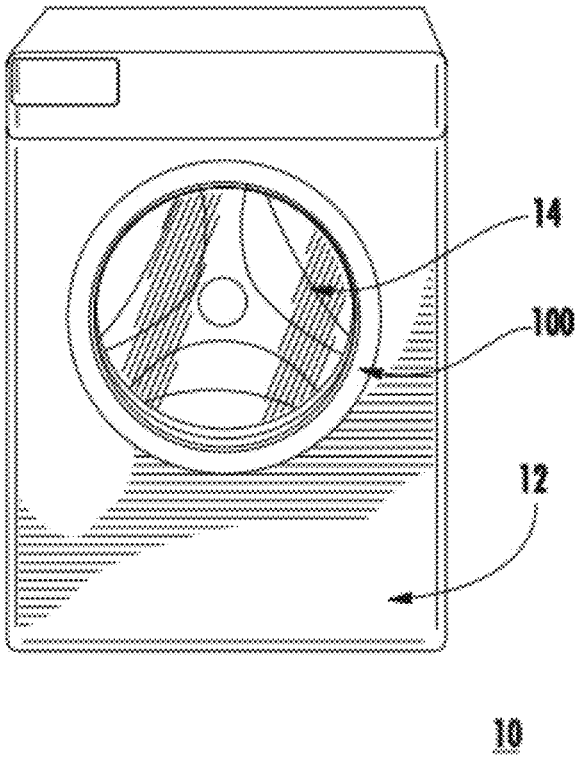
FIG. 1 illustrates a front view of a household appliance, according to an embodiment of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-10 illustrate exemplary embodiments of a door frame, a glass bowl, and an inner ring of a door assembly for a household appliance, such as a washer.

FIG. 1 illustrates a household appliance, for example, a washer 10, having a housing 12 and a door 100 connected to the housing 12. The door 100 is mounted with a hinge (not shown) to pivot with respect to the housing 12 between an open condition and a closed condition. FIG. 1 shows the door 100 in the closed condition. A rotating drum (not illustrated) and a drive device (not illustrated) for driving the rotating drum are disposed within the housing 12. The rotating drum receives clothes or laundry items for washing the items. FIG. 1 illustrates the door 100 on a horizontal axis washer 10.

The washer 10 can include an opening for accessing the rotating drum in the interior of the housing 12. The housing 12 of the washer 10 can have a hinge mounting surface configured to receive a hinge for pivoting the door 100 with respect to the washer 10. The hinge mounting surface can be located along the perimeter of the opening. The housing 12 can include a support surface or stamping that receives a door hook receptacle (not shown). The door hook receptacle can be configured to engage a door hook (not shown) of the door 100 for retaining the door 100 in a closed position.

With reference to FIGS. 2-9, an exemplary embodiment of a door frame 20, for example, for a washer 10, will now be described.

Figure 2:
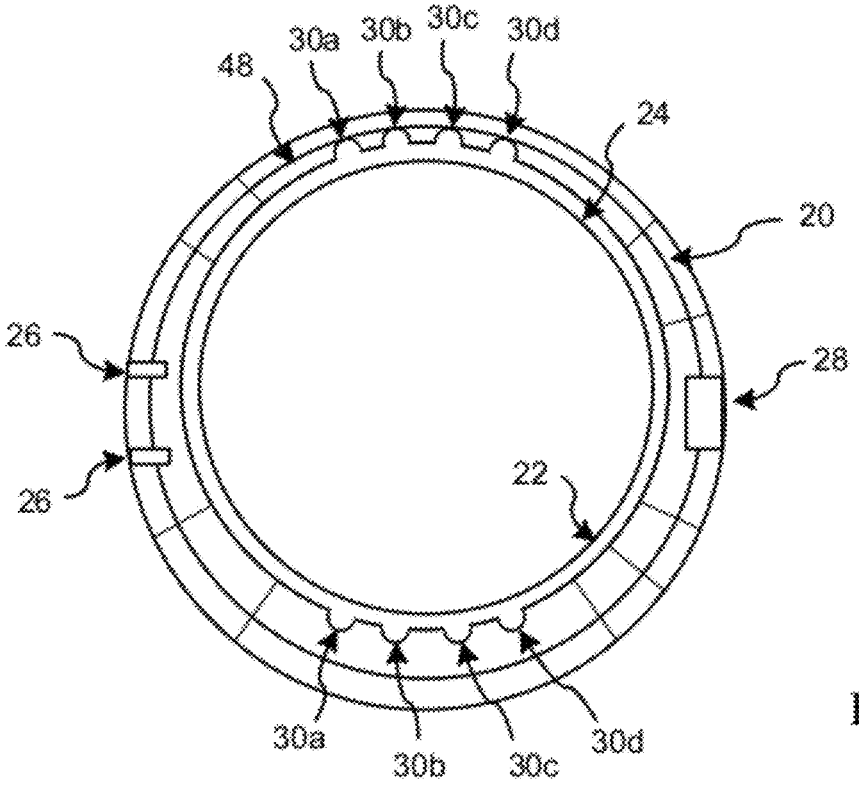
FIG. 2 illustrates a front view of a door frame according to an embodiment of the invention.
Figure 9:
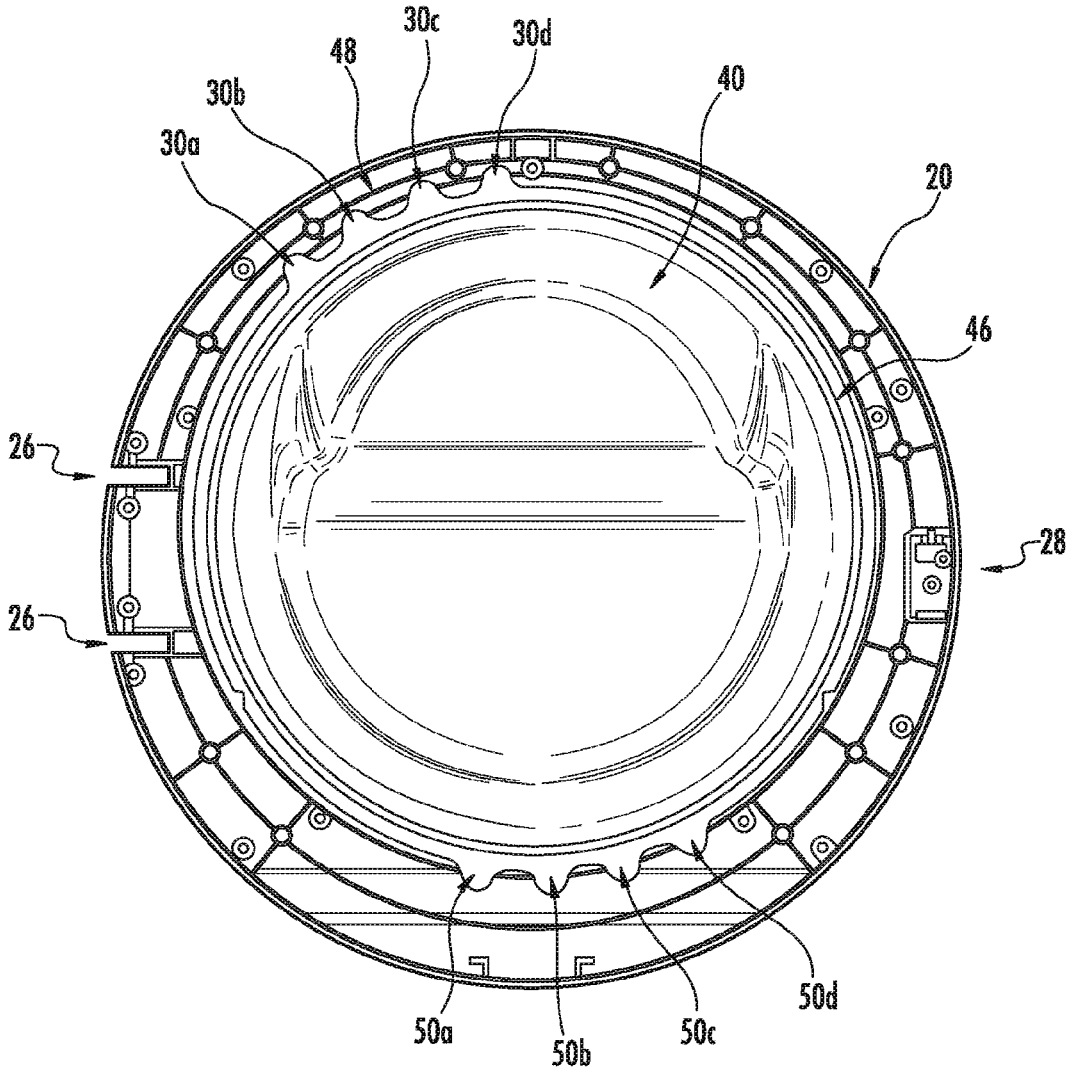
FIG. 9 illustrates a front view of an assembly of a glass bowl and a door frame according to an embodiment of the invention.
Figure 10:
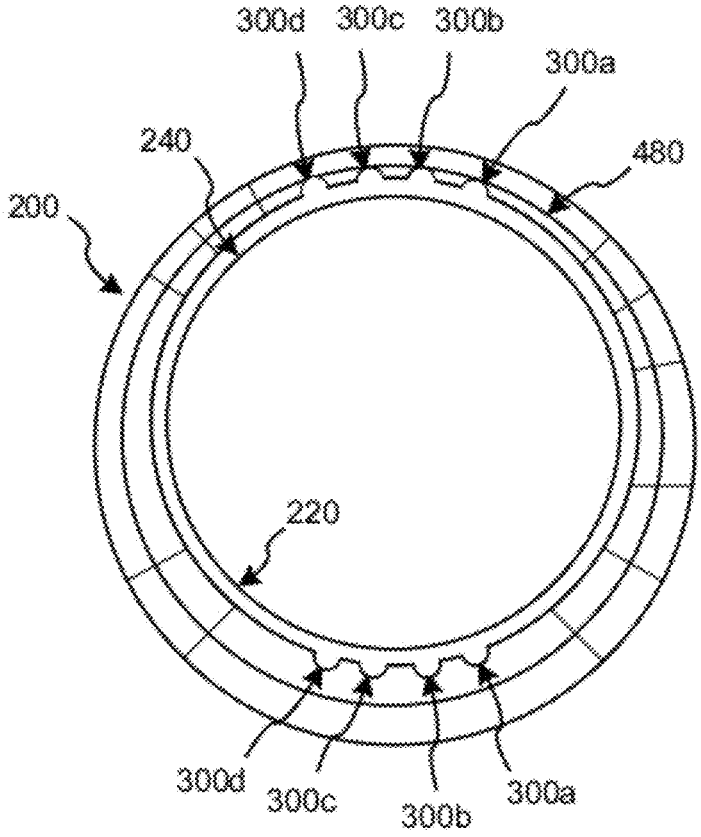
FIG. 10 illustrates a rear view of an inner ring according to an embodiment of the invention.
Figure 11A:
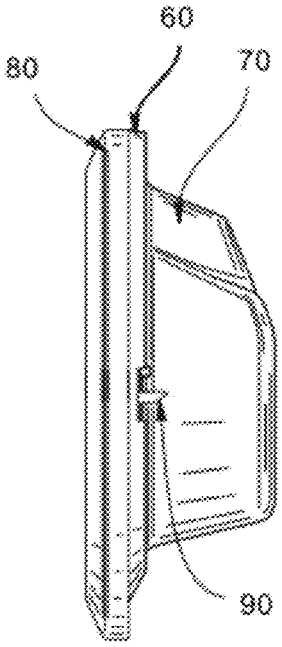
FIG. 11A CONVENTIONAL ART
FIG. 11A illustrates a perspective view of a conventional door assembly.
Figure 11B:
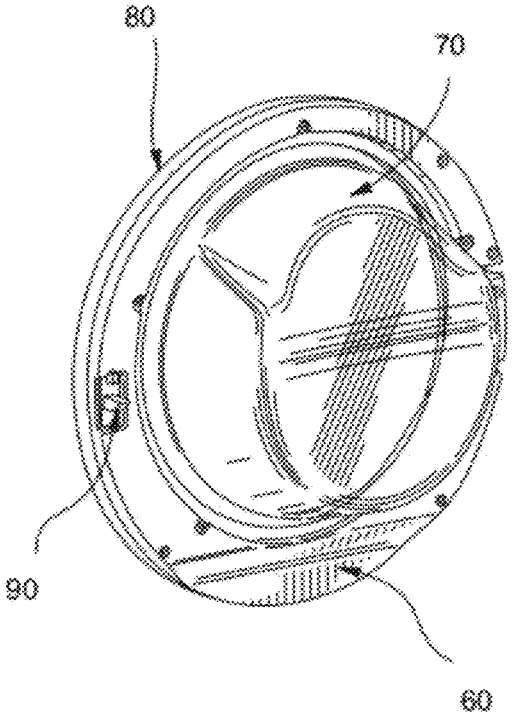
FIG. 11B CONVENTIONAL ART
FIG. 11B illustrates a side view of a conventional door assembly.
Figure 12:
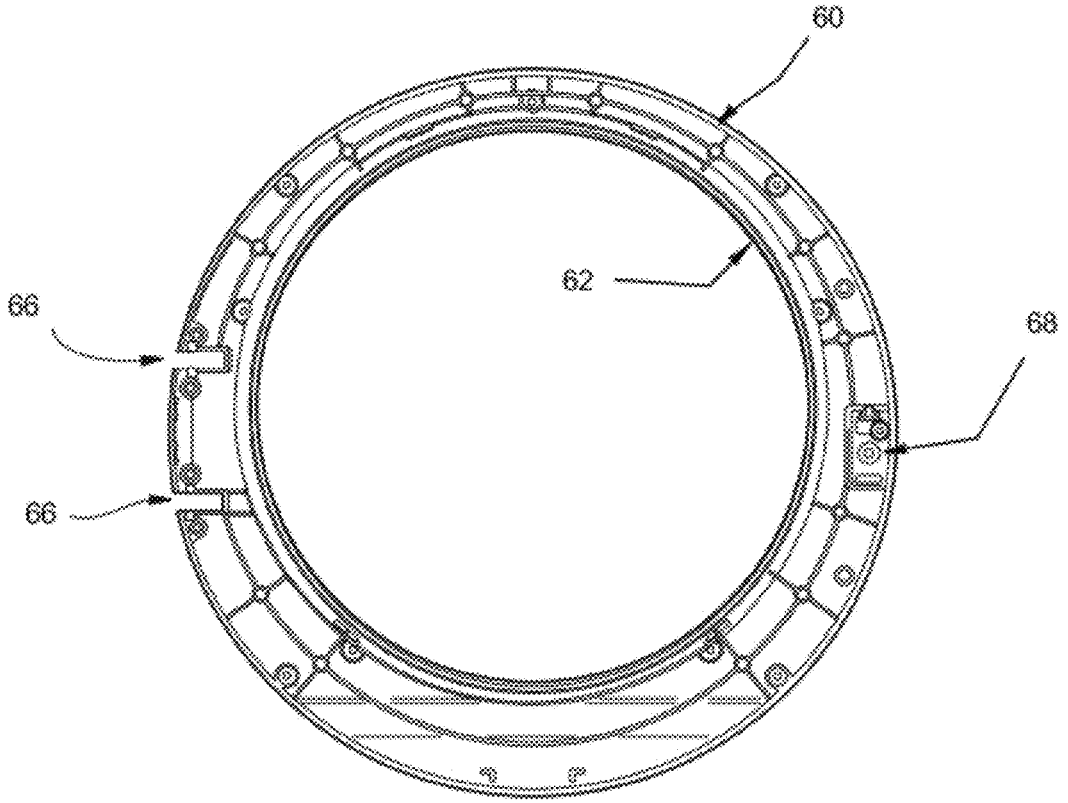
FIG. 12 CONVENTIONAL ART
FIG. 12 illustrates a front view of a conventional door frame.
Figure 13:
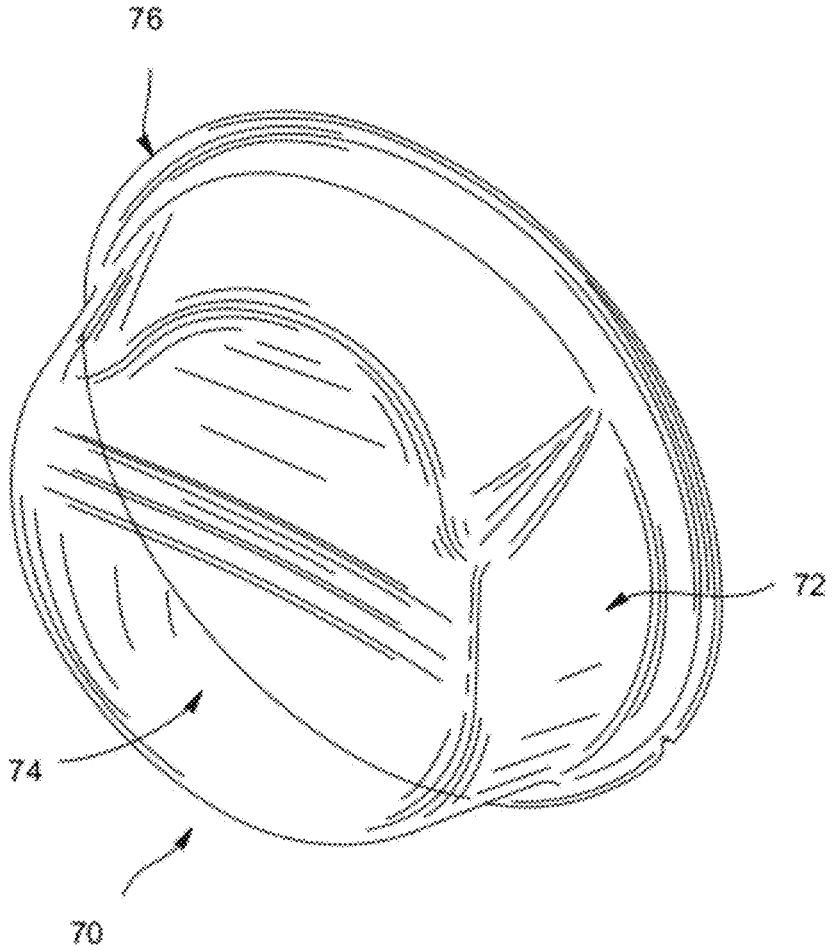
FIG. 13 CONVENTIONAL ART
FIG. 13 illustrates a rear, perspective view of a conventional glass bowl.

As shown in FIG. 2, an exemplary door frame 20 can have a substantially circular shape when viewed from the front. However, other shapes are contemplated within the spirit and scope of the invention. The door frame 20 can include an opening 22 that corresponds to a see-through portion 14 of the washer door 100 (see, e.g., FIG. 1). The opening 22 can have, for example, a circular or oval shape, as illustrated, another shape. The opening 22 can be centered (e.g., concentric) within the door frame 20, or off-center or offset from, or above, a center of the door frame 20 such that a distance from the opening 22 to the outside edge of the door frame 20 is greater at the bottom portion of the washer door 100 than at the top portion of the washer door 100. The door frame 20 can include a rib pattern 48 to stabilize and strengthen the door frame 20. The features of the door frame 20 can be configured to correspond to the features of the other components of the washer door, such as an inner ring (e.g., as shown in FIG. 10) or an outer cover (not shown). As shown in FIG. 9, the door frame 20 can include a plurality of fastener points, such as screw points, that correspond to locations of locating and/or clearance features of a plastic cover panel and/or a front ring of the door assembly. The door frame 20 can include hinge pockets 26 for receiving a hinge (not shown) and a portion 28 for engaging a door hook or latch (not shown in FIG. 9).

In an exemplary embodiment, the door frame 20 can include a stiffening feature for increasing the stiffness of the door assembly, which will be described in more detail below.

With reference again to FIGS. 2-9, an exemplary embodiment of a door bowl or a glass bowl 40 for a washer 10 will now be described.

The glass bowl 40 can include a base portion and a bowl portion. The base portion can include a flange 26 that extends radially from the bowl portion in a plane that corresponds to a plane of the door when in an assembled position. The bowl portion can include a sidewall 42 extending from the base portion toward the interior of the washing compartment of the washer 10. The sidewall 42 may be formed at an angle with respect to the plane of the flange 26. The bowl portion can include a face 44 that faces toward the interior of the washing compartment of the washer 10 in the assembled position. The intersection between the bowl face 44 and the sidewall 42 can be tapered or curved. A plane of the bowl face 44 can be parallel to the plane of the ring portion 24, can intersect the plane of the ring portion 24 at an angle, or the bowl portion can include a plurality of faces that intersect the sidewall 42, for example, at different angles.

In an exemplary embodiment, the glass bowl 40 can include a plurality of stiffening features for increasing the stiffness of the door assembly, which will be described in more detail below.

Figure 8:
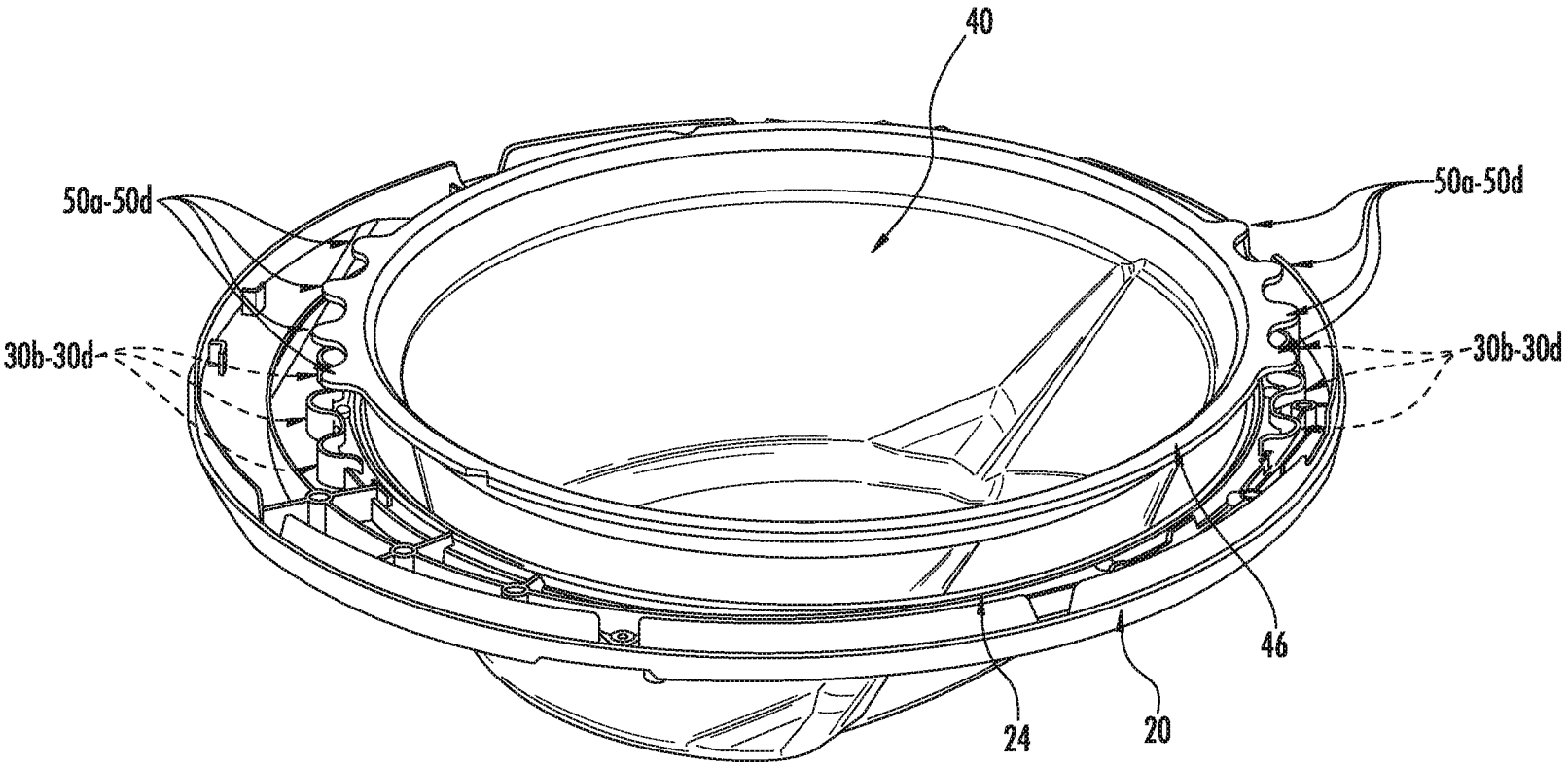
FIG. 8 illustrates a perspective, exploded view of a glass bowl and door frame according to an embodiment of the invention.

As shown in FIGS. 8 and 9, the glass bowl 40 can be assembled with the door frame 20 by inserting the bowl portion into the opening 22 of the door frame 20. As shown in FIG. 9, in the assembled position, the flange 26 of the glass bowl 40 engages the ring portion 24 of the door frame 20, while the face 44 and sidewall 42 of the bowl portion extend into the interior of the washing compartment of the washer 10. An inner ring 200 (e.g., as shown in FIG. 10) can be coupled to the door frame 20 to secure the flange 46 of the glass bowl 40 between the door frame 20 and the inner ring 200. An exemplary embodiment of the inner ring 200 will be described in more detail below with reference to FIG. 10.

The stiffening features 30*a*-30*d*; 50*a*-50*d* can increase the contact surface between the glass bowl 40 and the door frame 20 (or inner ring 200 in FIG. 10), thereby distributing the forces exerted on the door assembly over a larger area.

One or more of the locking portions 30*a*-30*d* on the door frame 20 can be positioned adjacent to a strengthening rib 48 that is already present in the design of the door frame 20. Preferably, one or more of the locking portions 30*a*-30*d* can be joined or integrally formed with the strengthening rib 48 such that the rib 48 reinforces the locking portions for transferring the forces applied to the locking portions to the strengthening rib 48.

With reference again to FIGS. 2-10, exemplary embodiments of a stiffening feature for increasing the stiffness of the door assembly will now be described.

In an exemplary embodiment, the stiffening feature can include one or more corresponding features (e.g., a pair of first, second, and/or third stiffening features) formed on the glass bowl 40, the frame 20, and/or the inner ring 200, respectively, that engage or lock with each other to rigidly fix the door frame 20 and/or the inner ring 200 with respect to the glass bowl 40.

Figure 3:
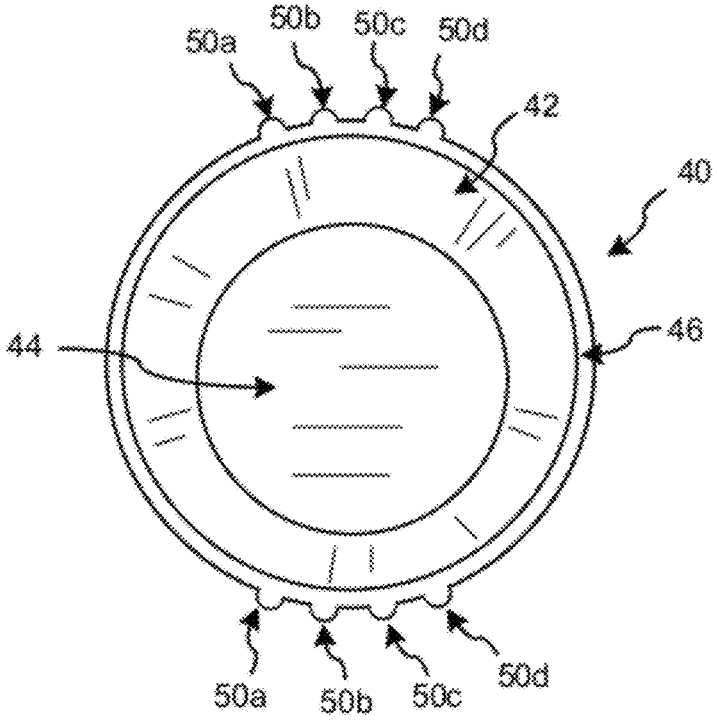
FIG. 3 illustrates a front view of a glass bowl according to an embodiment of the invention.
Figure 5:
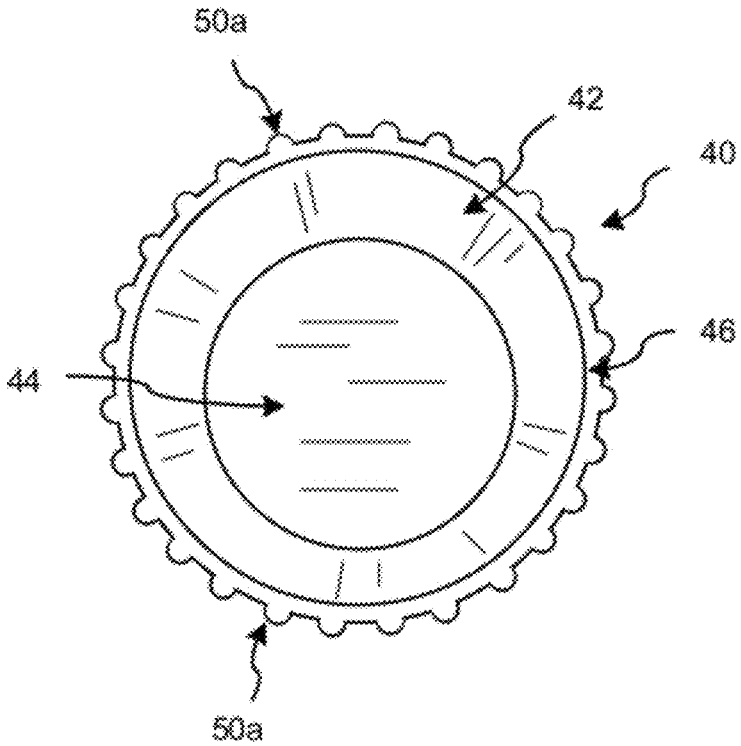
FIG. 5 illustrates a front view of a glass bowl according to another embodiment of the invention.
Figure 7:
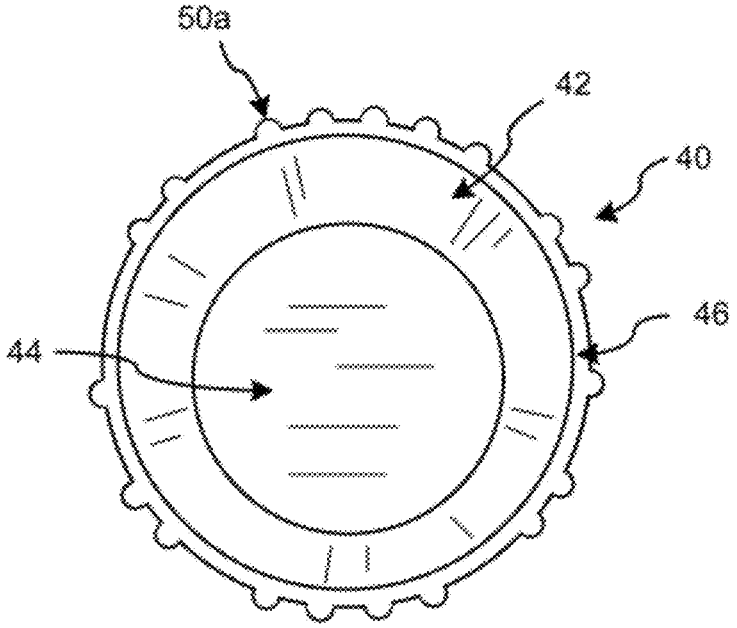
FIG. 7 illustrates a front view of a glass bowl according to another embodiment of the invention.

With reference to FIGS. 3, 5, and 7, a first stiffening feature can include one or more projections (e.g., 50*a*-50*d*) extending from the flange 26 of the glass bowl 40. The projections (e.g., 50*a*-50*d*) preferably extend radially from an outer edge of the flange 26 in a direction extending away from a center of the glass bowl 40. Preferably, the projections are integrally formed with the glass bowl 40, as illustrated in FIGS. 3, 5, and 7, to increase the stiffness between the flange 26 of the glass bowl 40 and the projections (e.g., 50*a*-50*d*).

As illustrated in FIGS. 3, 5, and 7, the projections (e.g., 50*a*-50*d*) can include, for example, semi-circular lobes extending from the outer edge of the flange 26. The projections are not limited to the semi-circular lobes illustrated, and can include various other suitable shapes, including but not limited to oval-, hexagonal-, square-, rectangular-, and star-shaped projections. In other embodiments, one or more of the projections can include an opening for engaging a projection, such as a pin, tab, key, or the like of another part of the door assembly, or for receiving a fastening device. Similarly, one of more of the projections can include a notch or groove on an edge of the projection for engaging a projection, such as a pin, tab, key, or the like, of another part of the door assembly, or for receiving a fastening device.

The projections (e.g., 50*a*-50) can include two, three, four, or any number of projections as may be appropriate for stiffening the connection between the glass bowl 40 and the door frame 20 (and/or outer door frame 200). The projections (e.g., 50*a*-50*d*) can be disposed at a variety of locations around a perimeter of the flange 26 of the glass bowl 40. For example, as illustrated in FIG. 5, the projections (e.g., 50*a*-50*d*) can be evenly spaced around the perimeter of the flange 26, or grouped together (e.g., in clusters) at various locations around the perimeter of the flange 26, as illustrated in FIGS. 3 and 7. The number of projections (e.g., 50*a*-50*d*) at each location can be the same or different depending on a location of the projections (e.g., 50*a*-50*d*) around the perimeter of the flange 26. Also, a distance between the projections (e.g., each successive projection) can be the same or it can vary around the perimeter of the flange 26. The projections (e.g., 50*a*-50*d*) can form various patterns around the perimeter of the flange 26, such as 3 projections-1 projection-3 projections, 3-2-3-2, etc., or other patterns, combinations, or random combinations. The projections (e.g., 50*a*-50*d*) can be formed separately, or two or more projections can be integrally formed or linked to each other, for example, to form a sinusoidal shape, step shape, such as an increasing step shape, decreasing step shape, or pyramidal step shape, etc.

The projections (e.g., 50*a*-50*d*) can be selectively oriented around the perimeter of the flange 26 based, for example, on areas that are susceptible to the application of higher forces (e.g., load paths) during use of the door assembly. For example, the projections can be positioned at the top (twelve o'clock position) and bottom (six o'clock position) of the glass bowl 40 when viewed from the front. As shown in FIGS. 8 and 9, the projections (e.g., 50*a*-50*d*) can be offset or positioned at different locations, for example, to accommodate existing features or designs of the glass bowl 40, door frame 20, or inner ring 200 (shown in FIG. 10), thereby minimizing changes to the existing design of the door assembly. For example, the flange 26 of the glass bowl 40 can include a plurality of projections (e.g., 50*a*-50*d*) in which a first group of four projections is formed on a first portion of the flange 26, and a second group of projections is formed on a second portion of the flange 26. In the exemplary embodiment, the first group is positioned, for example, substantially at or between the ten o'clock and twelve o'clock positions with respect to the perimeter of the flange 26, while the second group is positioned, for example, substantially at or between the five o'clock and six o'clock positions with respect to the perimeter of the flange 26 in order to accommodate existing features of the door assembly design. As explained above, other locations are possible within the spirit and scope of the invention.

With reference again to FIGS. 2-9, another embodiment of the stiffening feature for increasing the stiffness of the door assembly can include a plurality of second stiffening features formed on the door frame 20 that correspond to the projections of the glass bowl 40. The door frame 20 commonly can include a ring portion 24 that engages the flange 46 of the glass bowl 40 to secure the glass bowl 40, for example, between the door frame 20 and an outer door frame (not shown). In an exemplary embodiment, the door frame 20 can include a plurality of second stiffening features such as locking portions (e.g., 30*a*-30*d*), which can include receptacles, sockets, or the like, formed adjacent to, or integrally formed with, the ring portion 24. The locking portions (e.g., 30*a*-30*d*) preferably extend radially from an outer edge of the ring portion 24 in a direction extending away from a center of the door frame 20. Preferably, the locking portions (e.g., 30*a*-30*d*) are integrally formed with the door frame 20, as illustrated in FIGS. 3-5, to increase the stiffness between the locking portions (e.g., 30*a*-30*d*) and the door frame 20.

Figure 4:
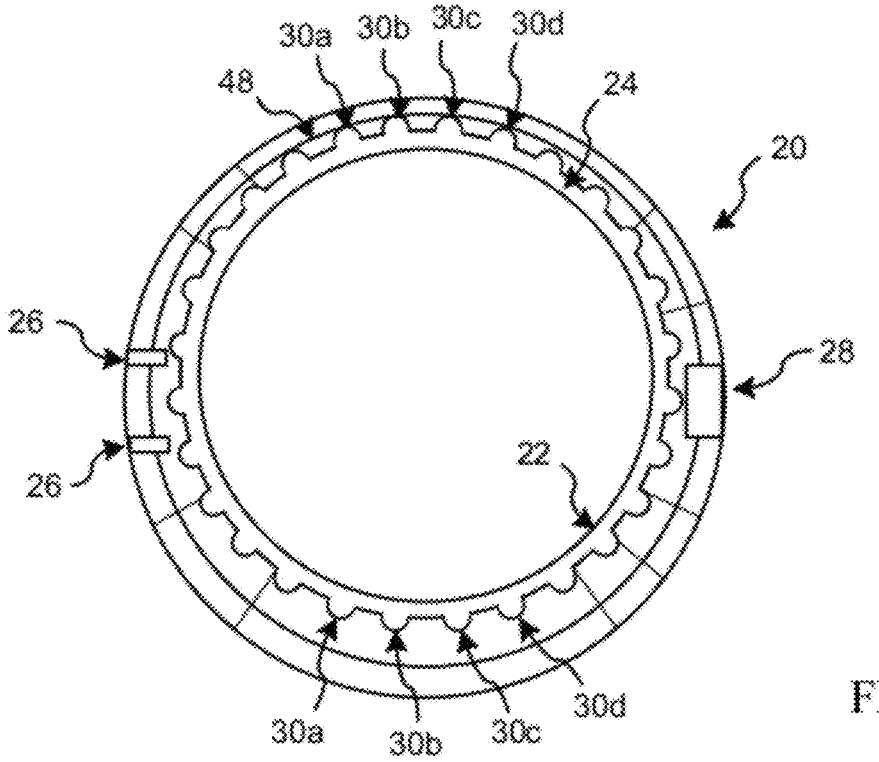
FIG. 4 illustrates a front view of a door frame according to another embodiment of the invention.

As illustrated in FIGS. 3-5, the locking portions (e.g., 30*a*-30*d*) can include, for example, semi-circular shapes extending from the outer edge of the ring portion 24 that correspond to a shape of the projections (e.g., 50*a*-50*d*) of the glass bowl 40. The locking portions are not limited to the semi-circular shapes illustrated, and can include various other suitable shapes, such as oval-, hexagonal-, square-, rectangular-, and star-shaped locking portions, depending on the shape of the projections (e.g., 50*a*-50*d*) of the glass bowl 40. A size of the locking portions (e.g., 30*a*-30*d*) can be selected to be substantially the same as, or slightly larger than, a size of the projections (e.g., 50*a*-50*d*) to permit the projections to be inserted into and securely engaged with the locking portions. In other embodiments, one or more of the locking portions can include a projection, such as a pin, tab, key, or the like, for engaging an opening in a projection of the glass bowl 40, or a groove, notch, etc. formed in an edge of the projection of the glass bowl 40.

Similar to the projections (e.g., 50*a*-50*d*), the door frame locking portions (e.g., 30*a*-30*d*) can include two, three, four, or any number of locking portions as may be appropriate for stiffening the connection between the glass bowl 40 and the door frame 20. The locking portions (e.g., 30*a*-30*d*) can be disposed at a variety of locations around a perimeter of the ring portion 24 of the door frame 20. For example, the locking portions (e.g., 30*a*-30*d*) can be evenly spaced around the perimeter, or grouped together (e.g., in clusters) at various locations around the perimeter of the ring portion 24, as exemplarily illustrated in FIG. 4. The number of locking portions (e.g., 30*a*-30*d*) at each location can be the same or different depending on a location of the locking portions (e.g., 30*a*-30*d*) around the perimeter of the ring portion 24. Also, a distance between the locking portions (e.g., each successive locking feature) can be the same or vary around the perimeter of the ring portion 24. The locking portions (e.g., 30*a*-30*d*) can form various patterns around the perimeter of the ring portion 24, such as three (3) locking portions-one (1) projection-three (3) locking portions, 3-2-3-2, etc., or other patterns, combinations, or random combinations. Preferably, the locking portions (e.g., 30*a*-30*d*) can be selectively oriented around the perimeter of the ring portion 24 based, for example, on areas that are susceptible to the application of higher forces (e.g., load paths) during use of the door assembly, or to accommodate existing features or designs of the door assembly.

The locking portions (e.g., 30*a*-30*d*) can be formed separately, or two or more locking portions can be integrally formed or linked to each other, for example, to form a sinusoidal shape, step shape, such as an increasing step shape, decreasing step shape, or pyramidal step shape, etc. The locking portions (e.g., 30*a*-30*d*) can be formed by one or more notches, grooves, or depressions formed into the front surface of the door frame 20, or by walls or projections extending out of the front surface of the door frame 20. Since the door frame 20 commonly is molded from plastic, the locking portions preferably can be integrally molded into the front surface of the door frame 20.

One or more of the locking portions 30*a*-30*d* on the door frame 20 can be positioned adjacent to a strengthening rib 48 that is already present in the design of the door frame 20. Preferably, one or more of the locking portions 30*a*-30*d* can be joined or integrally formed with the strengthening rib 48 such that the rib 48 reinforces the locking portions for transferring the forces applied to the locking portions to the strengthening rib 48.

As shown in FIGS. 8 and 9, the glass bowl 40 can be assembled with the door frame 20 by inserting the bowl portion into the opening 22 of the door frame 20 and aligning the projections (e.g., 50*a*-50*d*) of the glass bowl 40 with the locking portions (e.g., 30*a*-30*d*) of the door frame 20. In the assembled position, the flange 26 of the glass bowl 40 engages the ring portion 24 of the door frame 20, while the face 44 and sidewall 42 of the bowl portion extend into the interior of the washing compartment of the washer 10. The projections (e.g., 50*a*-50*d*) of the glass bowl 40 also engage the locking portions (e.g., 30*a*-30*d*) of the door frame 20.

With reference to FIG. 10, an inner ring 200 can be coupled to the door frame 20 to secure the flange 46 of the glass bowl 40 between the door frame 20 and the inner ring 200, and securing the projections (e.g., 50*a*-50*d*) of the glass bowl 40 within the locking portions (e.g., 30*a*-30*d*) of the door frame 20.

The inner ring 200 can include an opening 220 that corresponds to the opening 22 of the door frame 20 and the bowl portion of the glass bowl 40. The inner ring 200 can include a ring portion 224 that engages the opposite side of the flange 46 of the glass bowl 40 from the door frame 20 in order to secure (e.g., press-fit) the glass bowl 40 between the inner ring 200 and the door frame 20. In an embodiment, the inner ring 200 can include a surface (e.g., a flat surface) that presses against the opposite side of each of the projections (e.g., 50*a*-50*d*) of the glass bowl 40 when the inner frame 200 is secured against the door frame 20, or secures the projections (e.g., 50*a*-50*d*) of the glass bowl 40 in the locking portions (e.g., 30*a*-30*d*) of the inner frame 200.

As shown in FIG. 10, another embodiment of the stiffening feature for increasing the stiffness of the door assembly can include one or more third stiffening features formed on the inner frame 200 that correspond to and securely engage one or more of the corresponding stiffening features (e.g., projections 50*a*-50*d*) of the glass bowl 40. The stiffening features of the inner frame 200 can be in addition to, or as an alternative to, the stiffening features (e.g., locking portions 30*a*-30*d*) of the door frame 20.

Similar to the door frame 20, the inner ring 200 can include a plurality of stiffening features such as one or more locking portions (e.g., 300*a*-300*d*), such as receptacles, sockets, or the like, formed adjacent to, or integrally formed with, the ring portion 240. The locking portions (e.g., 300*a*-300*d*) preferably extend radially from an outer edge of the ring portion 240 in a direction extending away from a center of the inner ring 200. Preferably, the locking portions are integrally formed with the inner ring 200, as illustrated in FIG. 6, to increase the stiffness between the locking portions (e.g., 300*a*-300*d*) and the inner ring 200.

Figure 6:
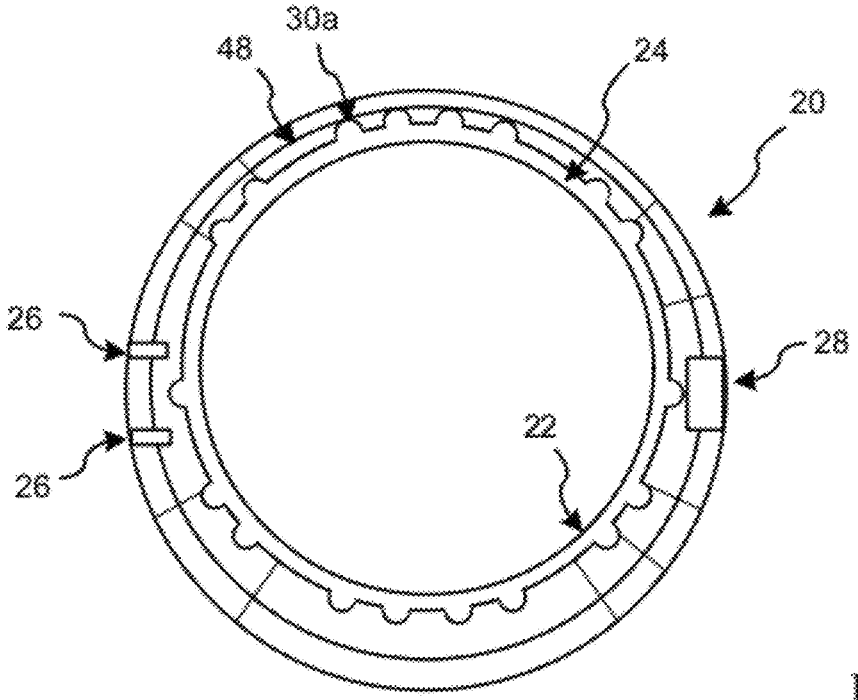
FIG. 6 illustrates a front view of a door frame according to another embodiment of the invention.

As illustrated in FIG. 6, the locking portions (e.g., 300*a*-300*d*) can include, for example, semi-circular shapes extending from the outer edge of the ring portion 240 that correspond to a shape of the projections (e.g., 50*a*-50*d*) of the glass bowl 40. The locking portions are not limited to the semi-circular shapes illustrated, and can include various other suitable shapes, such as oval-, hexagonal-, square-, rectangular-, star-shaped locking portions, depending on the shape of the projections (e.g., 50*a*-50*d*) of the glass bowl 40. A size of the locking portions (e.g., 300*a*-300*d*) can be selected to be substantially the same as, or slightly larger than, a size of the projections (e.g., 50*a*-50*d*) to permit the projections to be inserted into and securely engaged with the locking portions. In other embodiments, one or more of the inner ring locking portions can include a projection, such as a pin, tab, key, or the like, for engaging an opening in a projection of the glass bowl 40, or a groove, notch, etc. formed in an edge of the projection of the glass bowl 40.

Similar to the projections (e.g., 50*a*-50*d*), the inner ring locking portions (e.g., 300*a*-300*d*) can include two, three, four, or any number of locking portions as may be appropriate for stiffening the connection between the glass bowl 40 and the inner ring 200 (and/or door frame 20). The locking portions (e.g., 300*a*-300*d*) can be disposed at a variety of locations around a perimeter of the ring portion 240 of the inner ring 200. For example, the locking portions (e.g., 300*a*-300*d*) can be evenly spaced around the perimeter of the ring portion 240, or grouped together (e.g., in clusters) at various locations around the perimeter of the ring portion 240. The number of locking portions (e.g., 300*a*-300*d*) at each location can be the same or different depending on a location of the locking portions (e.g., 300*a*-300*d*) around the perimeter of the ring portion 240. Also, a distance between the locking portions (e.g., each successive locking feature) can be the same or vary around the perimeter of the ring portion 240. The locking portions (e.g., 300*a*-300*d*) can form various patterns around the perimeter of the ring portion 240, such as 3 locking portions-1 projection-3 locking portions, 3-2-3-2, etc., or other patterns, combinations, or random combinations. Preferably, the locking portions (e.g., 300*a*-300*d*) can be selectively oriented around the perimeter of the ring portion 240 based, for example, on areas that are susceptible to the application of higher forces (e.g., load paths) during use of the door assembly or to accommodate existing design features of the door assembly.

The locking portions (e.g., 300*a*-300*d*) can be formed separately, or two or more locking portions can be integrally formed or linked to each other, for example, to form a sinusoidal shape, step shape, such as an increasing step shape, decreasing step shape, or pyramidal step shape, etc. The locking portions (e.g., 300*a*-300*d*) can be formed by one or more notches, grooves, or depressions formed into the rear surface of the inner ring 200, or by walls or projections extending out of the rear surface of the inner ring 200. Since the inner ring 200 commonly is molded from plastic, the locking portions preferably can be integrally molded into the rear surface of the inner ring 200.

One or more of the locking portions 300*a*-300*d* on the inner ring 200 can be positioned adjacent to a strengthening rib 480 that is already present in the design of the inner ring 200. Preferably, one or more of the locking portions 300*a*-300*d* can be joined or integrally formed with the strengthening rib 480 such that the rib 480 reinforces the locking portions for transferring the forces applied to the locking portions to the strengthening rib 480.

Similar to the assembly shown in FIGS. 8 and 9, the glass bowl 40 can be assembled with the door frame 20 and the inner ring 200 by inserting the bowl portion into the opening 22 of the door frame 20. In the assembled position, the flange 46 of the glass bowl 40 engages the ring portion 24 of the door frame 20, while the face 44 and sidewall 42 of the bowl portion extend into the interior of the washing compartment of the washer 10. If the door frame 20 includes locking portions (e.g., 30*a*-30*d*), then the projections (e.g., 50*a*-50*d*) of the glass bowl 40 also can be aligned with the optional locking portions (e.g., 30*a*-30*d*) of the door frame 20. The projections (e.g., 50*a*-50*d*) of the glass bowl 40 can engage the optional locking portions (e.g., 30*a*-30*d*) of the door frame 20.

The inner ring 200 can then be positioned on the door frame 20 and the glass bowl 40 such that the projections (e.g., 50*a*-50*d*) of the glass bowl 40 are aligned with the locking portions (e.g., 300*a*-300*d*) of the inner frame 200. The inner ring 200 can be secured to the door frame 20 using fasteners, thereby securing the glass bowl 40, and particularly, the flange 46 and projections (e.g., 50*a*-50*d*), between the inner ring 200 and the door frame 20.

In an embodiment including both the locking portions (e.g., 30*a*-30*d*) of the door frame 20 and the locking portions (e.g., 300*a*-300*d*) of the inner ring 200, the projections (e.g., 50*a*-50*d*) can be secured (e.g., press-fit or sandwiched) between the locking portions (e.g., 30*a*-30*d*) of the door frame 20 and the locking portions (e.g., 300*a*-300*d*) of the inner ring 200, thereby rigidly fixing the glass bowl with respect to both the door frame 20 and the inner ring 200.

In an embodiment including both the locking portions (e.g., 30*a*-30*d*) and the locking portions (e.g., 300*a*-300*d*), the locking portions (e.g., 30*a*-30*d*) of the door frame 20 can be mirror images of the locking portions (e.g., 300*a*-300*d*) of the inner ring 200 such that the locking portions are opposed to each and aligned when the door frame 20 is assembled with the inner ring 200. All of the locking portions on the door frame 20 can be opposed and aligned with the locking portions of the inner ring 200, or a portion of the locking portions on the door frame 20 can be opposed and aligned with the locking portions of the inner ring 200. The locking portions on the door frame 20 can abut the locking portions of the inner ring 200, or engage into or around the locking portions of the inner ring, and vice versa.

In the exemplary embodiments, the projections from the flange of the glass bowl are illustrated as extending away from an edge of the ring portion 24 in a direction extending away from the center of the glass bowl. However, other embodiments are contemplated. For example, the plurality of stiffening features can be formed by shaping the edge of the flange 46 to include recesses extending in a direction toward the center of the glass bowl 40 such that the portions between the recesses form projections or tabs for engaging corresponding locking portions of the door frame 20 and/or inner ring 200.

As explained above, an exemplary embodiment of the invention is directed to a glass bowl (e.g., 40) for a door assembly (e.g., 100) of a washer (e.g., 10), the glass bowl (e.g., 40) comprising a bowl portion (e.g., 42, 44) having an open end and a closed end (e.g., 44); and a flange (e.g., 46) extending radially from a perimeter of the open end of the bowl portion (e.g., 42, 44) and in a plane that corresponds to a plane of the door assembly (e.g., 100) for securing the glass bowl (e.g., 40) to the door assembly (e.g., 100), wherein the flange (e.g., 46) includes a plurality of stiffening features (e.g., 50*a*-50*d*) for fixedly engaging a plurality of portions (e.g., 30*a*-30*d*, 300*a*-300*d*) of one of a door frame (e.g., 20) and an inner ring (e.g., 200) of the door assembly for increasing a stiffness of the door assembly (e.g., 100).

Another exemplary embodiment of the invention is directed to a door frame (e.g., 20, 200) for a door assembly (e.g., 100) of a washer (e.g., 10), the door frame (e.g., 20, 200) comprising a first face having an outside edge and an inside edge, wherein the inside edge defines an opening (e.g., 22, 220) in the first face that substantially corresponds to a shape of a glass bowl (e.g., 40) of the door assembly (e.g., 100), and wherein the first face includes a surface (e.g., 24, 240) surrounding a perimeter of the inside edge that abuts a flange (e.g., 46) of the glass bowl (e.g., 40) of the door assembly (e.g., 100) in an assembled state; and a second face on an opposite side of the door frame (e.g., 20, 200) from the first face; wherein the first face includes a plurality of stiffening features (e.g., 30*a*-30*d*, 300*a*, 300*d*) for fixedly engaging a plurality of portions (e.g., 50*a*-50*d*) of the flange (e.g., 46) of the glass bowl (e.g., 40) of the door assembly (e.g., 100) for increasing a stiffness of the door assembly (e.g., 100).

Yet another exemplary embodiment of the invention is directed to a washer (e.g., 10) comprising a housing (e.g., 12) having an opening for accessing an interior of the housing (e.g., 12); a tub disposed inside the housing, the tub having a rotating drum therein for receiving laundry through the opening; and a door assembly (e.g., 100) having a see-through portion for viewing into the tub, the door assembly (e.g., 100)

being pivotably coupled to the housing (e.g., 12) and movable between an open position for accessing the opening of the housing (e.g., 12) and a closed position for closing the opening of the housing (e.g., 12), wherein the door assembly (e.g., 100) includes a glass bowl (e.g., 40) including a bowl portion (e.g., 42, 44) having an open end and a closed end (e.g., 44) and a flange (e.g., 46) extending radially from a perimeter of the open end of the bowl portion (e.g., 42, 44) and in a plane that corresponds to a plane of the door assembly (e.g., 100) for securing the glass bowl (e.g., 40) to the door assembly (e.g., 100); a door frame (e.g., 20) having a first opening (e.g., 22) that receives the bowl portion (e.g., 42, 44) of the glass bowl (e.g., 40), and a first surface that surrounds the first opening (e.g., 22) and that is adjacent to a first side of the flange (e.g., 46) of the glass bowl (e.g., 40); and an inner ring (e.g., 200) having a second opening (e.g., 220) that corresponds to a shape of the bowl portion (e.g., 42, 44) of the glass bowl (e.g., 40), and a second surface that surrounds the second opening (e.g., 220) and that is adjacent to a second, opposite side of the flange (e.g., 46) of the glass bowl (e.g., 40), wherein the door frame (e.g., 20) and the inner ring (e.g., 200) cooperate to support the glass bowl (e.g., 40), and wherein the flange (e.g., 46) includes a plurality of first stiffening features (e.g., 50*a*-50*d*) fixedly engaging a plurality of second stiffening features (e.g., 30*a*-30*d*, 300*a*-300*d*) of one of the door frame (e.g., 20) and the inner ring (e.g., 200) of the door assembly (e.g., 100) for increasing a stiffness of the door assembly (e.g., 100).

The present invention has been described herein in terms of several preferred embodiments. However, modifications and additions to these embodiments will become apparent to those of ordinary skill in the art upon a reading of the foregoing description.

It is intended that all such modifications and additions comprise a part of the present invention to the extent that they fall within the scope of the several claims appended hereto.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

What is claimed is:

1. A glass bowl for a door assembly of a washer, the glass bowl comprising:

a bowl portion having an open end and a closed end; and a flange extending radially from a perimeter of the open end of the bowl portion and in a plane that corresponds to a plane of the door assembly for securing the glass bowl to the door assembly, wherein the flange includes a plurality of groups of stiffening features for fixedly engaging a plurality of portions of one of a door frame and an inner ring of the door assembly for increasing a stiffness of the door assembly, wherein the plurality of groups of stiffening features includes:

a first stiffening feature, a second stiffening feature, and a third stiffening feature successively arranged in series in a first direction on a perimeter of the flange, the first stiffening feature and the second stiffening feature being part of a first group at a first position on the perimeter of the flange, wherein a first distance extending in the first direction between the first stiffening feature and the second stiffening feature is less than a second distance extending in the first direction between the second stiffening feature and the third stiffening feature.

2. The glass bowl of claim 1, wherein the plurality of groups of stiffening features includes a plurality of groups of projections extending radially from the flange in directions away from a center of the glass bowl, the plurality of groups of projections for fixedly engaging a plurality of portions of the one of the door frame and the inner ring of the door assembly.

3. The glass bowl of claim 2 wherein the plurality of groups of projections includes a plurality of lobes extending radially from an edge of the flange.

4. The glass bowl of claim 3, wherein the plurality of groups of projections are disposed around a perimeter of the flange.

5. The glass bowl of claim 3, wherein the plurality of groups of projections are distributed evenly around a perimeter of the flange.

6. The glass bowl of claim 3, wherein the plurality of groups of projections are distributed in a pattern around a perimeter of the flange.

7. The glass bowl of claim 3, wherein the plurality of groups of projections includes a group of integrally formed projections having a substantially sinusoidal shape.

8. The glass bowl of claim 3, wherein the plurality of groups of projections includes a group of integrally formed projections having a step-shape.

9. The glass bowl of claim 1, wherein the plurality of groups of stiffening features includes a second group including the third stiffening feature and a fourth stiffening feature successively arranged in series in the first direction at a second position on the perimeter of the flange, and wherein a third distance extending in the first direction between the third stiffening feature and the fourth stiffening feature is less than the second distance extending in the first direction between the second stiffening feature and the third stiffening feature.

10. The glass bowl of claim 1, wherein the plurality of groups of stiffening features includes one of a plurality of groups of openings, notches, and grooves for fixedly engaging a plurality of groups of projections formed on the plurality of portions of the one of the door frame and the inner ring of the door assembly.

11. A door frame for a door assembly of a washer, the door frame comprising:

a first face having an outside edge and an inside edge, wherein the inside edge defines an opening in the first face that substantially corresponds to a shape of a glass bowl of the door assembly, and wherein the first face includes a surface surrounding a perimeter of the inside edge that abuts a flange of the glass bowl of the door assembly in an assembled state; and a second face on an opposite side of the door frame from the first face;

wherein the first face includes a plurality of groups of stiffening features for fixedly engaging a plurality of portions of the flange of the glass bowl of the door assembly for increasing a stiffness of the door assembly, wherein the plurality of groups of stiffening features includes:

a first stiffening feature, a second stiffening feature, and a third stiffening feature successively arranged in series in a first direction on the first face, the first stiffening feature and the second stiffening feature being part of a first group at a first position on the perimeter of the inside edge of the first face, wherein a first distance extending in the first direction between the first stiffening feature and the second stiffening feature is less than a second distance extending in the first direction between the second stiffening feature and the third stiffening feature, and wherein one of the first stiffening feature, the second stiffening feature, and the third stiffening feature includes a closed perimeter outer wall configured to fixedly engage one of a plurality of portions of the flange of the glass bowl of the door assembly.

12. The door frame of claim 11, wherein the plurality of groups of stiffening features includes a plurality of groups of locking portions that project away from a surface of the first face for fixedly engaging the plurality of portions of the flange of the glass bowl of the door assembly.

13. The door frame of claim 11, wherein the plurality of groups of stiffening features includes a plurality of groups of locking portions that are recessed in a surface of the first face for fixedly engaging the plurality of portions of the flange of the glass bowl of the door assembly.

14. The door frame of claim 11, wherein the plurality of groups of stiffening features includes a plurality of groups of locking portions for fixedly engaging the plurality of portions of the flange of the glass bowl of the door assembly, and wherein the plurality of locking portions includes one of a socket and a receptacle.

15. The door frame of claim 11, wherein each of the plurality of groups of stiffening features has a predetermined shape corresponding to a shape of the plurality of portions of the flange of the glass bowl.

16. The door frame of claim 11, comprising:

a rib on the first face for strengthening the door frame, wherein the rib reinforces one of the plurality of groups of stiffening features.

17. The door frame of claim 11, wherein the plurality of groups of stiffening features includes a plurality of groups of locking portions for fixedly engaging the plurality of portions of the flange of the glass bowl of the door assembly, wherein the plurality of portions of the flange include a plurality of projections extending radially from an edge of the flange, and wherein the plurality of groups of locking portions includes a plurality of groups of sockets or receptacles for fixedly engaging the plurality of projections of the flange of the glass bowl.

18. The door frame of claim 11, wherein the plurality of groups of stiffening features includes a plurality of groups of locking portions for fixedly engaging the plurality of portions of the flange of the glass bowl of the door assembly, and wherein the plurality of groups of locking portions are disposed around the perimeter of the inside edge of the first face.

19. The door frame of claim 11, wherein the plurality of groups of stiffening features includes a plurality of groups of locking portions for fixedly engaging the plurality of portions of the flange of the glass bowl of the door assembly, and wherein the plurality of groups of locking portions are distributed evenly around the perimeter of the inside edge of the first face.

20. The door frame of claim 11, wherein the plurality of groups of stiffening features includes a plurality of groups of locking portions for fixedly engaging the plurality of portions of the flange of the glass bowl of the door assembly, and wherein the plurality of groups of locking portions are distributed in a pattern around the perimeter of the inside edge of the first face.

21. The door frame of claim 11, wherein the plurality of groups of stiffening features includes a second group including the third stiffening feature and a fourth stiffening feature successively arranged in series in the first direction at a second position on the perimeter of the inside edge of the first face, and wherein a third distance extending in the first direction between the third stiffening feature and the fourth stiffening feature is less than the second distance extending in the first direction between the second stiffening feature and the third stiffening feature.

22. The door frame of claim 11, wherein the plurality of groups of stiffening features includes a plurality of groups of locking portions for fixedly engaging the plurality of portions of the flange of the glass bowl of the door assembly, and wherein the plurality of locking portions includes a group of integrally formed locking portions having a substantially sinusoidal shape.

23. The door frame of claim 11, wherein the plurality of groups of stiffening features includes a plurality of groups of locking portions for fixedly engaging the plurality of portions of the flange of the glass bowl of the door assembly, and wherein the plurality of groups of stiffening features includes a plurality of projections for fixedly engaging one of a plurality of openings, notches, and grooves formed on the plurality of portions of the glass bowl of the door assembly.

24. The door frame of claim 11, wherein the door frame comprises one of an inner door frame and an inner ring of a door assembly.

25. The door frame of claim 11, wherein the plurality of groups of stiffening features includes a plurality of groups of locking portions for fixedly engaging the plurality of portions of the flange of the glass bowl of the door assembly, and wherein the plurality of groups of locking portions includes a group of integrally formed locking portions having a step-shape.

26. The door frame of claim 11, wherein each of the first stiffening feature, the second stiffening feature, and the third stiffening feature includes a closed perimeter outer wall configured to fixedly engage one of the plurality of portions of the flange of the glass bowl for increasing the stiffness of the door assembly.

27. The door frame of claim 26, wherein the closed perimeter outer wall extends continuously in the first direction from the first stiffening feature to the second stiffening feature.

28. A washer comprising:

a housing having an opening for accessing an interior of the housing;

a tub disposed inside the housing, the tub having a rotating drum therein for receiving laundry through the opening; and a door assembly having a see-through portion for viewing into the tub, the door assembly being pivotably coupled to the housing and movable between an open position for accessing the opening of the housing and a closed position for closing the opening of the housing, wherein the door assembly includes:

a glass bowl including a bowl portion having an open end and a closed end and a flange extending radially from a perimeter of the open end of the bowl portion and in a plane that corresponds to a plane of the door assembly for securing the glass bowl to the door assembly;

a door frame having a first opening that receives the bowl portion of the glass bowl, and a first surface that surrounds the first opening and that is adjacent to a first side of the flange of the glass bowl; and an inner ring having a second opening that corresponds to a shape of the bowl portion of the glass bowl, and a second surface that surrounds the second opening and that is adjacent to a second, opposite side of the flange of the glass bowl, wherein the door frame and the inner ring cooperate to support the glass bowl, the door frame being secured to the inner ring, and the flange of the glass bowl being press-fit between the first surface of the door frame and the second surface of the inner ring, and wherein the flange includes a plurality of groups of first stiffening features fixedly engaging a plurality of groups of second stiffening features of one of the door frame and the inner ring of the door assembly such that forces applied to the door assembly are transferred along predetermined load paths by the plurality of groups of second stiffening features of the one of the door frame and the inner ring to the plurality of groups of first stiffening features of the glass bowl to increase a stiffness of the door assembly, wherein the plurality of groups of first stiffening features includes:

a first stiffening feature, a second stiffening feature, and a third stiffening feature successively arranged in series in a first direction on a perimeter of the flange, the first stiffening feature and the second stiffening feature being part of a first group at a first position on the perimeter of the flange, wherein a first distance extending in the first direction between the first stiffening feature and the second stiffening feature is less than a second distance extending in the first direction between the second stiffening feature and the third stiffening feature.

29. The washer of claim 28, wherein the plurality of first stiffening features includes a plurality of projections extending radially from the flange in a direction away from a center of the glass bowl, and wherein the plurality of second stiffening features of the one of the door frame and the inner ring of the door assembly includes a plurality of locking portions that fixedly engages the plurality of projections of the glass bowl.

30. The washer of claim 29, wherein each of the plurality of projections has a predetermined shape and size corresponding to a shape and size of a corresponding locking portion of the plurality of locking portions.

31. The washer of claim 30, wherein each of the plurality of projections includes a lobe extending radially from an edge of the flange, and wherein each of the plurality of locking portions includes a socket or receptacle fixedly engaging the lobe of each of the plurality of projections.

32. The washer of claim 30, wherein the plurality of projections includes a first group of at least two adjacent projections at a first position on a perimeter of the flange, and a second group of at least two adjacent projections at a second position on the perimeter of the flange, wherein the plurality of locking portions includes a first group of at least two adjacent locking portions at a first position on a perimeter of the first surface of the door frame or the second surface of the inner ring, and a second group of at least two adjacent locking portions at a second position on the perimeter of the first surface of the door frame or the second surface of the inner ring, wherein the first position of the first group of the plurality of projections corresponds to the first position of the first group of the plurality of locking portions, wherein the second position of the second group of the plurality of projections corresponds to the second position of the second group of the plurality of locking portions, and wherein a distance between the first group and the second group of the plurality of projections is greater than a distance between the at least two adjacent projections of each of the first group and the second group.

33. The washer of claim 29, wherein the plurality of projections includes a group of integrally formed projections having a substantially sinusoidal shape, and wherein the plurality of locking portions includes a group of integrally formed locking portions having a shape corresponding to the substantially sinusoidal shape of the group of integrally formed projections.

34. The washer of claim 28, wherein the plurality of first stiffening features includes a plurality of locking portions for fixedly engaging the plurality of second stiffening features of the one of the door frame and the inner ring of the door assembly, wherein the plurality of second stiffening features includes a plurality of projections.

35. The washer of claim 28, wherein the one of the door frame and the inner ring of the door assembly includes a rib for strengthening the one of the door frame and the inner ring, and wherein the rib reinforces one of the plurality of second stiffening features.

36. A washer comprising:

a housing having an opening for accessing an interior of the housing;

a tub disposed inside the housing, the tub having a rotating drum therein for receiving laundry through the opening; and a door assembly having a see-through portion for viewing into the tub, the door assembly being pivotably coupled to the housing and movable between an open position for accessing the opening of the housing and a closed position for closing the opening of the housing, wherein the door assembly includes:

a glass bowl including a bowl portion having an open end and a closed end and a flange extending radially from a perimeter of the open end of the bowl portion and in a plane that corresponds to a plane of the door assembly for securing the glass bowl to the door assembly;

a door frame having a first opening that receives the bowl portion of the glass bowl, and a first surface that surrounds the first opening and that is adjacent to a first side of the flange of the glass bowl; and an inner ring having a second opening that corresponds to a shape of the bowl portion of the glass bowl, and a second surface that surrounds the second opening and that is adjacent to a second, opposite side of the flange of the glass bowl, wherein the door frame and the inner ring cooperate to support the glass bowl, wherein the flange includes a plurality of first stiffening features fixedly engaging a plurality of second stiffening features of one of the door frame and the inner ring of the door assembly for increasing a stiffness of the door assembly, wherein the door frame includes the plurality of second stiffening features and the inner ring includes a plurality of third stiffening features, and wherein the plurality of first stiffening features fixedly engages the plurality of second stiffening features of the door frame and the plurality of third stiffening features of the inner ring.

* * * * *